US007124554B2

(12) United States Patent
Biondi et al.

(10) Patent No.: US 7,124,554 B2
(45) Date of Patent: Oct. 24, 2006

(54) METHOD AND MACHINE FOR PRODUCING A PACKAGE WITH A COUPON

(75) Inventors: Andrea Biondi, Bologna (IT); Franco Spisni, Monghidoro (IT); Marco Musiani, San Lazzaro di Savena (IT); Flavio Trebbi, San Lazzaro di Savena (IT); Stefano Negrini, Calderara di Reno (IT)

(73) Assignee: G.D. Societa' per Azioni, Bologna (IT)

( * ) Notice: Subject to any disclaimer, the term of this patent is extended or adjusted under 35 U.S.C. 154(b) by 45 days.

(21) Appl. No.: 11/016,817

(22) Filed: Dec. 21, 2004

(65) Prior Publication Data

US 2005/0166550 A1 Aug. 4, 2005

(30) Foreign Application Priority Data

Dec. 22, 2003 (IT) ..... BO2003A0768

(51) Int. Cl.
*B65B 61/20* (2006.01)
*B65B 11/00* (2006.01)

(52) U.S. Cl. ..... 53/415; 53/466; 53/135.1; 53/228

(58) Field of Classification Search ..... 53/415, 53/466, 135.1, 135.2, 136.1, 228, 232, 233, 53/234; 156/273.1, 566
See application file for complete search history.

(56) References Cited

U.S. PATENT DOCUMENTS 3,462,909 A * 8/1969 Anderson ..... 156/273.1
3,762,628 A * 10/1973 Sargent ..... 383/40
3,892,614 A * 7/1975 Levy ..... 156/273.1
4,182,222 A * 1/1980 Stahl ..... 156/273.1
4,354,894 A * 10/1982 Lewis et al. ..... 156/566
4,757,667 A 7/1988 Elsner
5,203,953 A * 4/1993 Focke et al. ..... 156/566
5,309,695 A * 5/1994 Frabetti et al. ..... 53/136.1
6,105,340 A * 8/2000 Draghetti ..... 53/415
6,438,927 B1 * 8/2002 Focke et al. ..... 53/415
6,467,621 B1 10/2002 Ishida
6,669,015 B1 * 12/2003 Draghetti et al. ..... 53/415
6,684,606 B1 * 2/2004 Draghetti ..... 53/415
2004/0250513 A1 * 12/2004 Focke et al. ..... 53/415

FOREIGN PATENT DOCUMENTS

DE 198 41 526 A1 3/2000
WO WO 00/35756 A1 6/2000

* cited by examiner

*Primary Examiner*—Louis Huynh
(74) *Attorney, Agent, or Firm*—Birch, Stewart, Kolasch & Birch, LLP

(57) ABSTRACT

A method and machine for producing a package with a coupon, whereby a product is fed to a packing station via a feed station, where the coupon is applied on to a top wall of the product; at the packing station, a sheet of packing material is wrapped about the product to enclose both the product and the coupon, and, between the feed station and the packing station, the coupon is subjected to an electric field and charged electrostatically, so as to adhere electrostatically to the product; the electric field is generated by at least one fixed guide, which is parallel to the path so as to face the top wall of the product, and comprises a number of conducting bodies having a high direct voltage with respect to an electric earth.

31 Claims, 4 Drawing Sheets

METHOD AND MACHINE FOR PRODUCING A PACKAGE WITH A COUPON

The present invention relates to a method and a machine for producing a package with a coupon.

The present invention may be used to advantage for producing a packet of cigarettes with a coupon, which is located between a paper inner package containing a group of cigarettes, and a heat-sealed outer overwrapping of transparent plastic material.

BACKGROUND OF THE INVENTION

A packet of cigarettes comprises a group of cigarettes; a soft inner sheet of packing material, normally foil, wrapped about the group of cigarettes; and an outer sheet of packing material enclosing the inner sheet of packing material. The outer sheet of packing material may be soft or rigid, and, if rigid, is defined by a cardboard blank having preformed fold lines, and which is folded to form a rigid, hinged-lid packet of cigarettes.

Both soft and rigid packets of cigarettes are subsequently wrapped in a sheet of transparent plastic overwrapping material (normally cellophane or polypropylene), which is heat-sealed to preserve the moisture and aroma of the tobacco.

Packets of cigarettes sometimes contain a coupon in the form of a flat or pleated slip printed with advertising or collectors' item pictures. A coupon is normally located between the outer sheet of packing material and the sheet of transparent plastic overwrapping material, so that it is visible without opening the packet, and to prevent it coming into direct contact with the cigarettes, in which case the odour of the colourings in the print on the coupon may alter the aroma of the tobacco.

U.S. Pat. No. 6,105,340-B1 describes a method of producing packets of cigarettes with respective government stamps and coupons. More specifically, the packets of cigarettes are transferred in orderly succession directly from a packing machine to a cellophaning machine; a respective government stamp and respective coupon are applied to the outer surface of each packet of cigarettes as the packets are transferred; and a sheet of transparent packing material is wrapped and sealed about each packet of cigarettes and the respective government stamp and coupon.

A drawback of known methods, as described above, of producing a sealed packet of cigarettes with a coupon is the instability of the position and orientation of the coupon with respect to the packet, which obviously impairs the look of the finished packet. That is, between the point at which the coupon is applied to the packet of cigarettes, and the point at which the sheet of transparent packing material is wrapped about the packet and coupon, thus stabilizing the position and orientation of the coupon, the coupon undergoes random movements as the packet moves along.

By way of a solution to the above drawback, it has been proposed to supply the coupon together with the sheet of transparent packing material. This, however, involves serious design problems, by having to supply two different materials together in a precise relative position.

Another proposed solution is to fix the coupon to the packet of cigarettes with a spot of glue. This, however, is unpopular, on account of a portion of the coupon having to be torn off to detach the coupon from the packet, thus spoiling the look of the coupon and/or packet.

U.S. Pat. No. 4,757,667-A1 discloses a roll-wrapping method where rolls are wrapped with an envelope of heat-shrink plastic film with a label positioned between the envelope and roll and electrostatically bonded to the film; the bond prevents misalignment of the label prior to heat shrinking of the film onto the roll.

JP-7267217-A discloses an apparatus for holding an address label onto a bundle of articles during the feeding of the bundle of articles together with the address label to a wrapping station. Upstream from the wrapping station, it is provided a feeding station for feeding onto each bundle of articles an address label, so as the address label is arranged inside the package and is surround by a blank of the package. For preventing the address label from dropping from the bundle of articles during the transferring between the feeding station and the wrapping station, static electricity is charged to the address label so that the address label is sucked to the bundle of articles. In particular a charging electrode connected to a direct-current high-voltage transformer assembly is arranged in the feeding station, i.e. in the region of the feeding of the address label onto the bundle of articles.

SUMMARY OF THE INVENTION

It is an object of the present invention to provide a method and a machine for producing a package with a coupon, designed to eliminate the aforementioned drawbacks, and which in particular are cheap and easy to implement.

According to the present invention, there is provided a method and a machine for producing a package with a coupon, as claimed in the attached claims.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
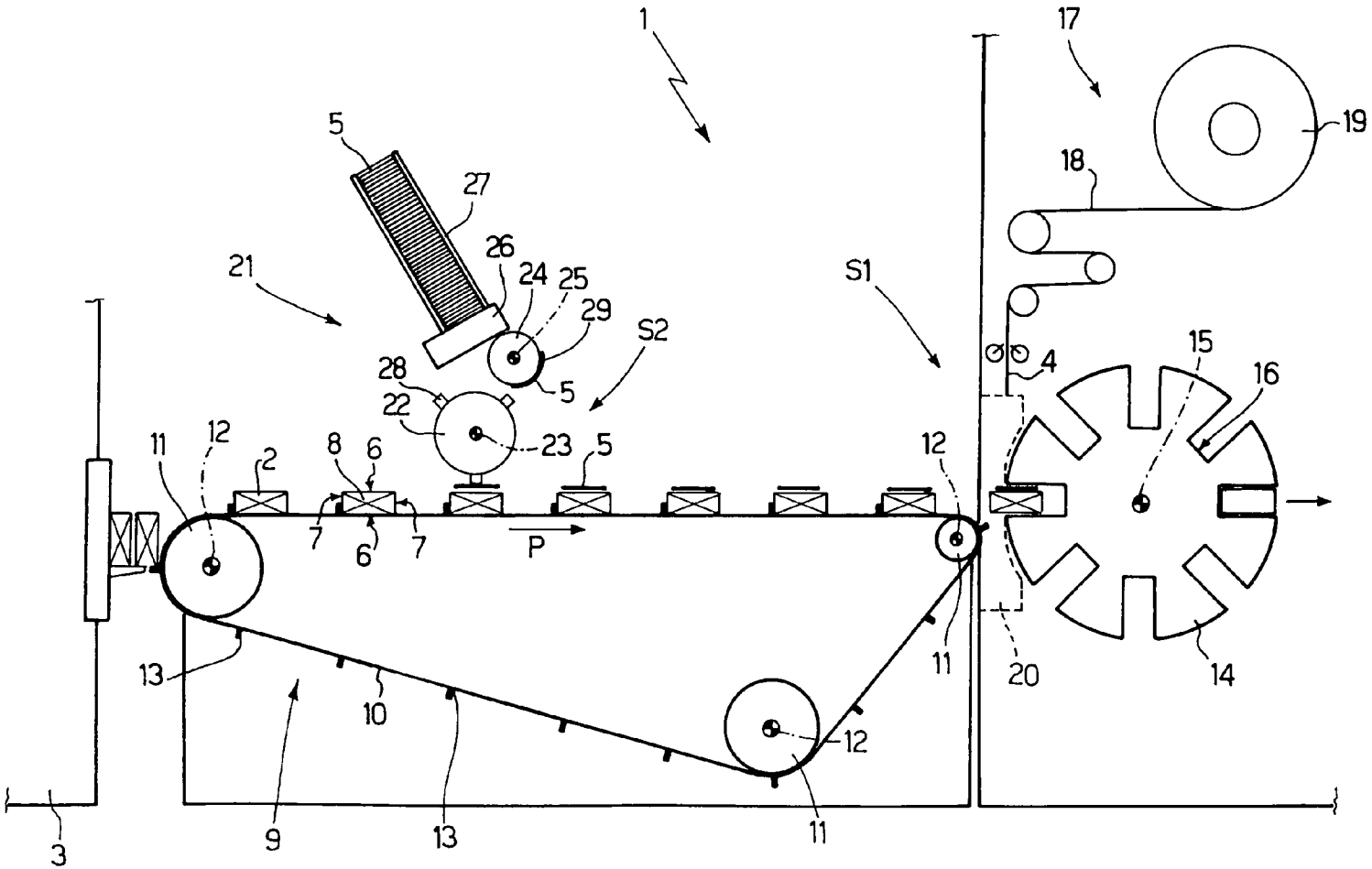
FIG. 1 shows a schematic cross section of a preferred embodiment of a machine for producing a package with a coupon, in accordance with the present invention.

With reference to the accompanying drawings, number 1 indicates as a whole a cellophaning machine (shown partly), which receives a succession of packets 2 of cigarettes from a packing machine 3 (shown schematically), and wraps a respective sheet 4 of transparent plastic overwrapping material (normally cellophane or polypropylene) about each packet 2 of cigarettes. Once wrapped about respective packet 2 of cigarettes, sheet 4 of overwrapping material is heat-sealed to preserve the moisture and aroma of the tobacco. To each packet 2 of cigarettes is applied a respective coupon 5, normally defined by an advertising insert and/or discount coupon, and which is located between packet 2 of cigarettes and sheet 4 of overwrapping material, so that it is visible and maintained in a desired position by sheet 4 of overwrapping material.

More specifically, each packet 2 of cigarettes is parallelepiped-shaped, and is bounded by an opaque paper packing material defining an outer surface comprising two opposite, parallel main walls 6, two opposite, parallel lateral walls 7, and two opposite, parallel end walls 8. Coupon 5 is rectangular, is smaller than a main wall 6, and is applied to packet 2 of cigarettes so as to rest on a main wall 6.

Cellophaning machine 1 comprises a belt conveyor 9, in turn comprising a belt 10 looped about pulleys 11 rotating about respective axes 12 perpendicular to the FIG. 1 plane. Belt 10 comprises a succession of pockets equally spaced along belt 10 and defined by partitions 13 crosswise to the longitudinal extension of belt 10. Belt 10 comprises a work branch extending in a substantially horizontal direction and defining a path P, along which packets 2 of cigarettes are fed from an output of packing machine 3 to a packing station S1 via a feed station S2. At feed station S2, a coupon 5 is applied to respective packet 2 of cigarettes; and, at packing station S1, a sheet 4 of overwrapping material is wrapped and sealed about a respective packet 2 of cigarettes with a coupon 5.

Packing station S1 comprises a packing wheel 14 rotating about an axis 15 parallel to axes 12 of pulleys 11, and having a number of pockets 16, each for housing a respective packet 2 of cigarettes. Packing station S1 also comprises an unwinding and cutting device 17 for unwinding a strip 18 off a reel 19, and cutting sheets 4 of overwrapping material successively off strip 18; and a feed device 20 for feeding sheets 4 of overwrapping material, in a direction crosswise to path P, between conveyor 9 and packing wheel 14. Each packet 2 of cigarettes transferred from conveyor 9 to a respective pocket 16 of packing wheel 14 intercepts a respective sheet 4 of overwrapping material, so that sheet 4 of overwrapping material is folded into a U about packet 2 of cigarettes.

Feed station S2 is located along path P, and comprises an application device 21 for applying coupons 5. Application device 21 comprises an application drum 22 for applying coupons 5, and which rotates about an axis 23 parallel to axis 15 of packing wheel 14, and is located directly over conveyor 9; and a pickup drum 24 for picking up coupons 5, and which rotates about an axis 25 parallel to axis 23, is substantially tangent to application drum 22, and is located at an extracting device 26 for extracting coupons 5 from a store 27 of coupons 5. Application drum 22 and pickup drum 24 have respective suction seats 28 and 29 for retaining coupons 5 during transfer.

Figure 2:
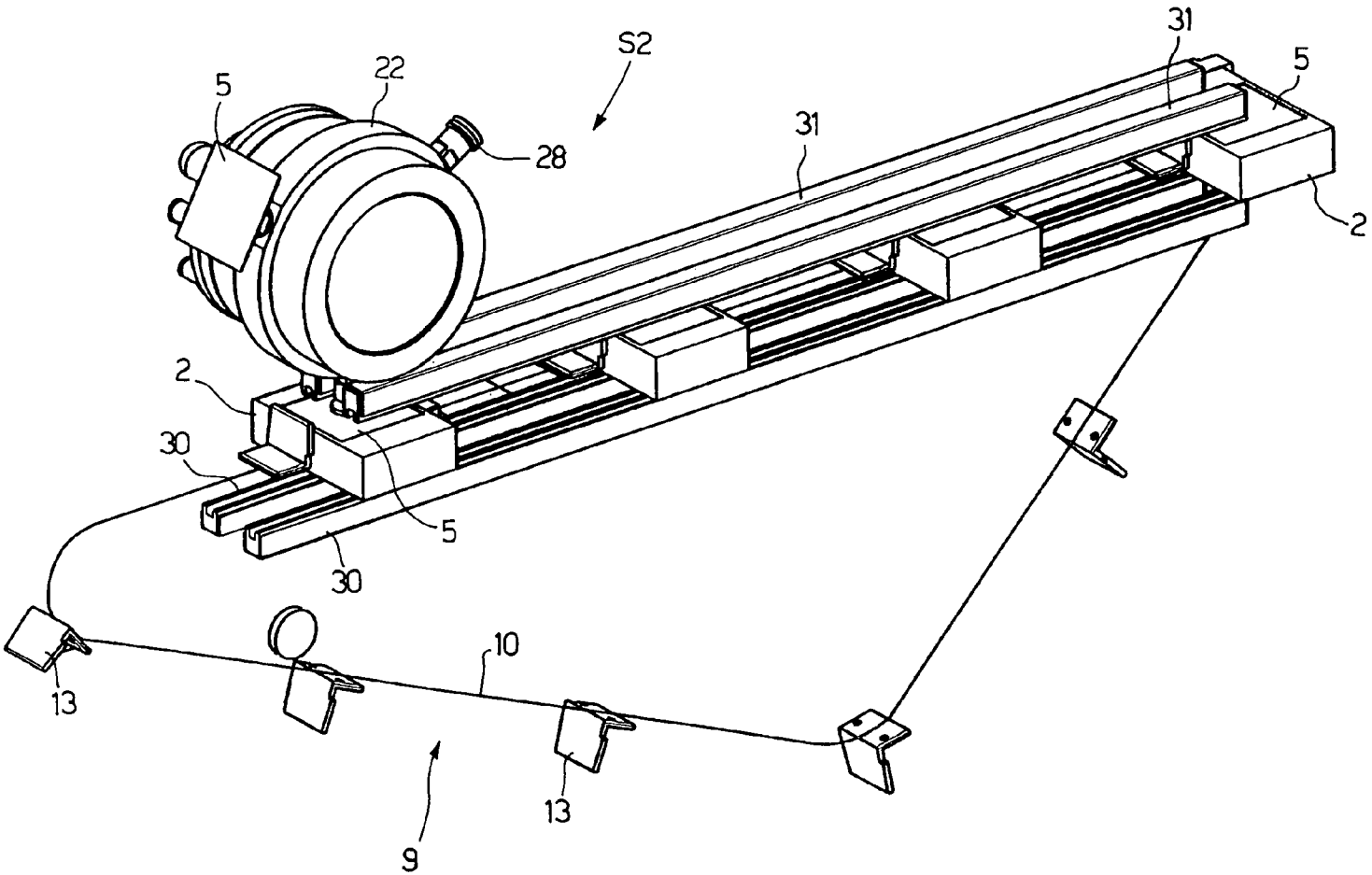
FIG. 2 shows a view in perspective, with parts removed for clarity, of a conveyor in FIG. 1.

As shown in FIG. 2, conveyor 9 comprises two fixed, horizontal, bottom guides 30, which are parallel and spaced apart to allow partitions 13 to travel inside the gap between the two bottom guides 30 to push packets 2 along path P. More specifically, each packet 2 rests with a bottom main wall 6 resting horizontally on the two bottom guides 30, and is slid along the two bottom guides 30 by conveyor 9. As of feed station S2, conveyor 9 also comprises two fixed, horizontal, top guides 31, which are parallel and spaced apart so as to face the corresponding two bottom guides 30. As of feed station S2, top guides 31 and bottom guides 30 therefore define a channel, along which packets 2, together with respective coupons 5, are fed along path P by conveyor 9 to packing station S1.

Finally, cellophaning machine 1 comprises an electrostatic device 32 located between feed station S2 and packing station S1, and which subjects each coupon 5 to an electric field, so that coupon 5 is charged electrostatically and so adheres electrostatically to respective packet 2 of cigarettes along path P.

Figure 3:
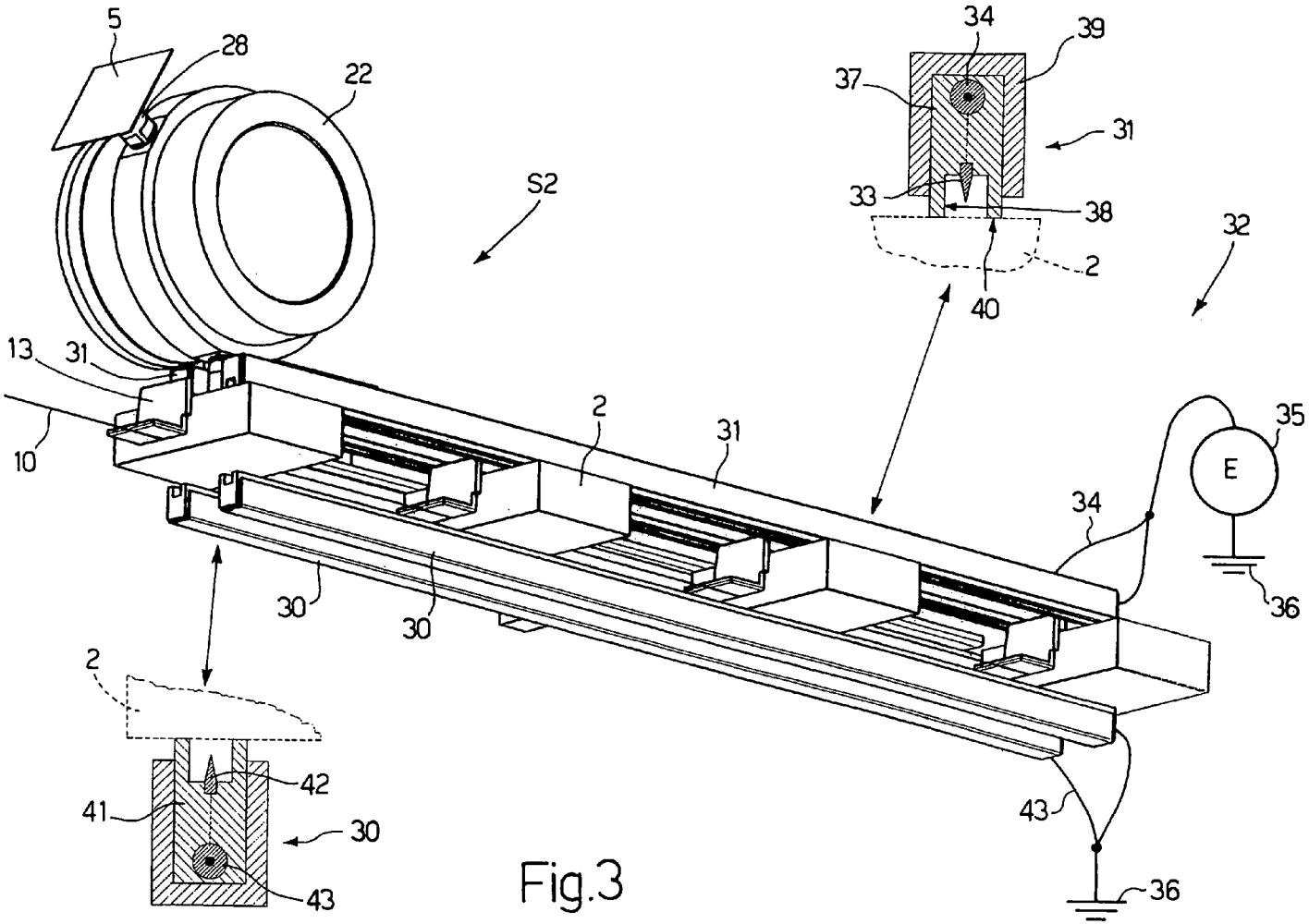
FIG. 3 shows a further view in perspective, with parts removed for clarity, of the FIG. 2 conveyor.
Figure 4:
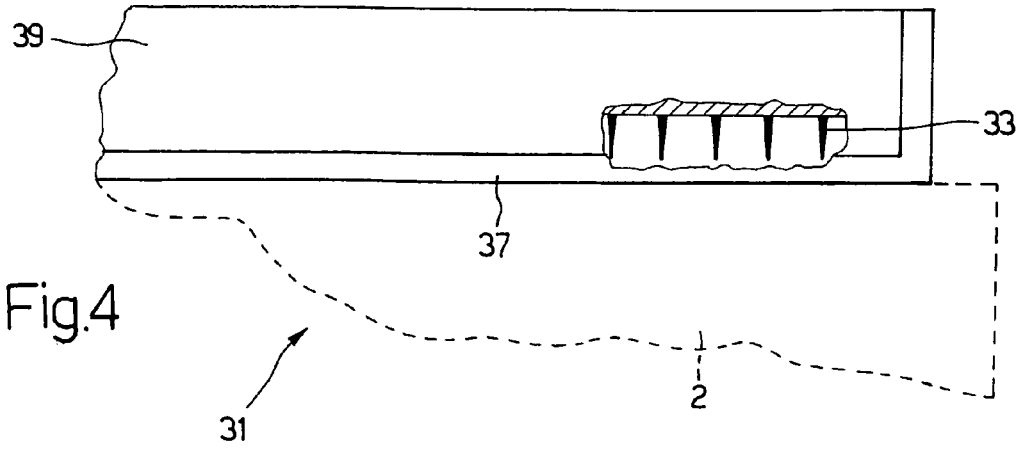
FIG. 4 shows a side view of a fixed guide of the FIG. 2 and 3 conveyor.

As shown in FIG. 3, electrostatic device 32 comprises a number of conducting bodies 33 fitted to each top guide 31 and connected electrically by an electric cable 34 to an electric generator 35 for charging conducting bodies 33 to a high direct voltage with respect to an electric earth 36 (roughly 10–15 kV). Conducting bodies 33 are equally spaced along top guide 31, and are each pointed, with the pointed end facing packets 2 of cigarettes.

Figure 5:
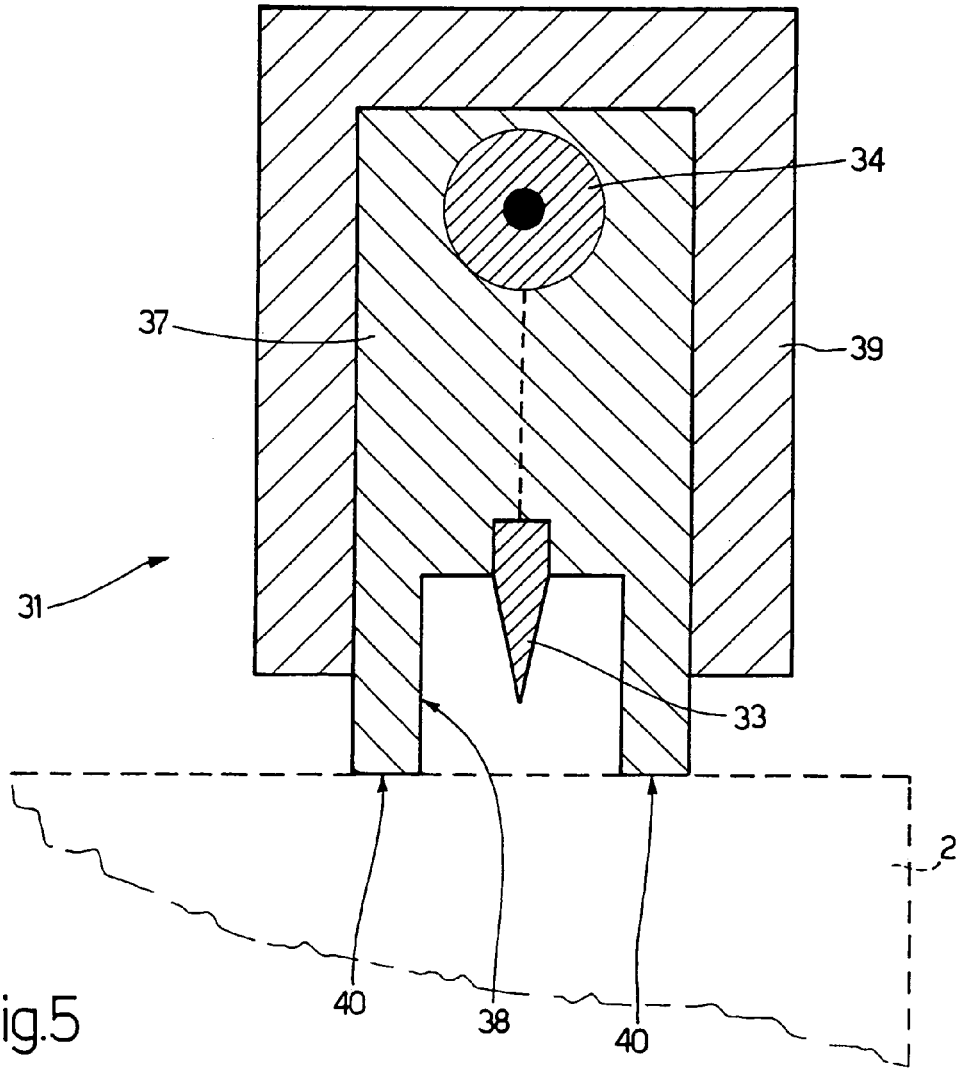
FIG. 5 shows a larger-scale cross section of the fixed guide in FIG. 4.

As shown in FIG. 5, each top guide 31 comprises a channel section 37 made of electrically insulating plastic material, and having a central channel 38 housing conducting bodies 33; and electric cable 34 is embedded in section 37. Section 37 is fitted inside a further channel section 39 made of metal, connected preferably to earth 36, and which connects top guide 31 mechanically to the frame (not shown in detail) of cellophaning machine 1. As shown clearly in FIG. 5, the height of the walls of channel 38 is greater than that of conducting bodies 33, and packets 2 of cigarettes slide along a horizontal bottom surface 40 of section 37; for which reason, section 37 is preferably made of low-friction plastic material, such as teflon.

Bottom guides 30 are identical with top guides 31 as described above, and comprise respective sections 41 made of plastic material and housing corresponding pointed conducting bodies 42 connected directly to electric earth 36 by respective electric cables 43.

In an alternative embodiment not shown, electric cable 43 connects conducting bodies 42 to a further electric generator for charging conducting bodies 42 to a high direct voltage with respect to electric earth 36 and opposite in sign to the voltage of conducting bodies 33. Alternatively, the further electric generator charges conducting bodies 42 to an alternating voltage with respect to electric earth 36, which voltage varies with time between a positive and negative value, so as to perform a de-electrifying function.

In an alternative embodiment not shown, electrostatic device 32 also subjects each coupon 5 to an electric field before coupon 5 is applied to respective packet 2 of cigarettes.

In an alternative embodiment not shown, electrostatic device 32 only subjects each coupon 5 to an electric field before coupon 5 is applied to respective packet 2 of cigarettes.

In actual use, packing machine 3 releases packets 2 successively onto conveyor 9, so that each packet 2 is inserted inside a respective pocket defined by a partition 13, and with one main wall 6 resting horizontally on bottom guides 30. Each packet 2 of cigarettes inside a respective pocket on conveyor 9 is fed by a respective partition 13 continuously along path P towards packing station S1 and through feed station S2, where it is supplied by application device 21 with a respective coupon 5 placed on top main wall 6, i.e. the main wall 6 opposite the main wall 6 resting on bottom guides 30. As soon as it receives respective coupon 5, each packet 2 of cigarettes enters the channel defined by bottom guides 30 and top guides 31, and is subjected to the electric field generated by electrostatic device 32.

By virtue of the electrostatic forces generated by electrostatic device 32, each coupon 5 is secured firmly, as positioned by application device 21, to respective packet 2 of cigarettes, and undergoes no undesired random movement induced by the forward movement of packet 2 of cigarettes.

On reaching packing station S1, each packet 2 of cigarettes intercepts a corresponding sheet 4 of overwrapping material, which is folded into a U about packet 2 of cigarettes as packet 2 of cigarettes is inserted inside a respective pocket 16 on packing wheel 14. Each pocket 16 feeds the respective packet 2 of cigarettes, together with respective coupon 5, through a number of folding stations (not shown in detail) to fold the two free portions of sheet 4 of overwrapping material one on top of the other to form a tubular wrapping having two open ends, and to fold the two open ends onto packet 2 of cigarettes to form a closed wrapping. The closed wrapping is then stabilized by heat sealing the superimposed portions of the folded sheet 4 of overwrapping material, thus firmly stabilizing the position of coupon 5 with respect to packet 2 of cigarettes.

The above method obviously also applies, with no major alterations required, to other than cigarette packing applications, and may advantageously be used for producing any type of package with a coupon. For example, the above method may be used for producing a package with a coupon, containing a confectionery product, food product, publishing product, detergent product, personal hygiene product, or electronic product.

The invention claimed is:

1. A method of producing a package with a coupon; the method comprising the steps of:

feeding a product (2) along a path (P) to a packing station (S1) via a feed station (S2) with a top wall (6) of the product positioned horizontally;

applying the coupon (5) on the top wall (6) of the product (2) at the feed station (S2);

subjecting the coupon (5) to an electric field between the feed station (S2) and the packing station (S1), so that the coupon (5) is charged electrostatically and adheres electrostatically to the product (2) along the path (P); and wrapping a sheet (4) of packing material about the product (2), to enclose both the product (2) and the coupon (5), at the packing station (S1);

the method is characterized in that the electric field is generated by at least one fixed first guide (31), which is parallel to the path (P) so as to-face the top wall (6) of the product (2), and comprises a number of first conducting bodies (33) having a high direct voltage with respect to an electric earth (36).

2. A method as claimed in claim 1, wherein the first conducting bodies (33) are equally spaced along the first guide (31); each first conducting body (33) being pointed, with the pointed end facing the product (2).

3. A method as claimed in claim 1, wherein at least one fixed second guide (30) is provided parallel to the path (P) and on the opposite side of the product (2) to the first guide (31), and comprises a number of second conducting bodies (42).

4. A method as claimed in claim 3, wherein the second conducting bodies (42) are equally spaced along the second guide (30); each second conducting body (42) being pointed, with the pointed end facing the product (2).

5. A method as claimed in claim 3, wherein the second conducting bodies (42) are connected to the electric earth (36).

6. A method as claimed in claim 3, wherein the second conducting bodies (42) have a high direct voltage with respect to the electric earth (36), and opposite in sign to the voltage of the first conducting bodies (33).

7. A method as claimed in claim 3, wherein the second conducting bodies (42) have an alternating voltage with respect to the electric earth (36), which voltage varies with time between a positive value and a negative value, so as to perform a de-electrifying function.

8. A method as claimed in claim 3, wherein the first and second guide (31, 30) define a channel along which the product (2) is fed along the path (P) by a conveyor (9).

9. A method as claimed in claim 8, wherein a bottom wall (6) of the product (2), parallel to and opposite the top wall (6), rests on the second guide (30), and is slid along the second guide (30) by the conveyor (9).

10. A method as claimed in claim 9, wherein two parallel, spaced second guides (30) are provided; the conveyor (9) comprising a movable push member (13) located in the gap between the two second guides (30).

11. A method as claimed in claim 1, wherein the sheet (4) of packing material is fed crosswise to the path (P) at the packing station (S1), so as to be intercepted by the product (2) and so folded into a U about the product (2); the path (P) terminating at a packing wheel (14) having a pocket (16), which receives the product (2) and the coupon (5) wrapped in the U-folded sheet (4) of packing material, and feeds the product (2) and the coupon (5) through a number of folding stations to fold the two free portions of the sheet (4) of packing material one on top of the other to form a tubular wrapping having two open ends, and to fold the two open ends onto the product (2) to form a closed wrapping.

12. A method as claimed in claim 11, wherein the closed wrapping is stabilized by heat sealing superimposed portions of the folded sheet (4) of packing material.

13. A method as claimed in claim 1, wherein the feed station (S2) comprises a feed wheel (22), which moves a suction gripping head (28) between a pickup station, where it receives the coupon (5), to a release station, where it applies the coupon (5) to the product (2).

14. A method as claimed in claim 1, wherein the product (2) is a packet of cigarettes, and the sheet (4) of packing material is made of transparent plastic material.

15. A machine for producing a package with a coupon; the machine (1) comprising:

a feed station (S2) for applying the coupon (5) on a top wall (6) of a product (2);

a packing station (S1) for wrapping a sheet (4) of packing material about the product (2), to enclose both the product (2) and the coupon (5);

a conveyor (9) for feeding the product (2) along a path (P) to the packing station (S1) via the feed station (S2) and with the top wall (6) of the product positioned horizontally; and an electrostatic device (32) located between the feed station (S2) and the packing station (S1) for subjecting the coupon (5) to an electric field, so that the coupon (5) is charged electrostatically and adheres electrostatically to the product (2) along the path (P);

the machine (1) is characterized in that the electrostatic device (32) comprises at least one fixed first guide (31), which generates the electric field, is parallel to the path (P) so as to face the top wall (6) of the product (2), and comprises a number of first conducting bodies (33) having a high direct voltage with respect to an electric earth (36).

16. A machine as claimed in claim 15, wherein the first conducting bodies (33) are equally spaced along the first guide (31); each first conducting body (33) being pointed, with the pointed end facing the product (2).

17. A machine as claimed in claim 16, wherein the first guide (31) comprises a central first channel (38) defined by a U-shaped member (37) of electrically insulating material, and housing the first conducting bodies (33).

18. A machine as claimed in claim 17, wherein the height of the walls of the first channel (38) is greater than the height of the first conducting bodies (33).

19. A machine as claimed in claim 15, wherein at least one fixed second guide (30) is provided parallel to the path (P) and on the opposite side of the product (2) to the first guide (31), and comprises a number of second conducting bodies (42).

20. A machine as claimed in claim 19, wherein the second conducting bodies (42) are equally spaced along the second guide (30); each second conducting body (42) being pointed, with the pointed end facing the product (2).

21. A machine as claimed in claim 20, wherein the second guide (30) comprises a central second channel defined by a U-shaped member (41) of electrically insulating material, and housing the second conducting bodies (42).

22. A machine as claimed in claim 21, wherein the height of the walls of the second channel is greater than the height of the second conducting bodies (42).

23. A machine as claimed in claim 19, wherein the second conducting bodies (42) are connected to the electric earth (36).

24. A machine as claimed in claim 19, wherein the second conducting bodies (42) have a high direct voltage with respect to the electric earth (36), and opposite in sign to the voltage of the first conducting bodies (33).

25. A machine as claimed in claim 19, wherein the second conducting bodies (42) have an alternating voltage with respect to the electric earth (36), which voltage varies with time between a positive value and a negative value, so as to perform a de-electrifying function.

26. A machine as claimed in claim 19, wherein the first and second guide (31, 30) define a channel along which the product (2) is fed along the path (P) by a conveyor (9).

27. A machine as claimed in claim 26, wherein a bottom wall (6) of the product (2), parallel to and opposite the top wall (6), rests on the second guide (30), and is slid along the second guide (30) by the conveyor (9).

28. A machine as claimed in claim 27, wherein two parallel, spaced second guides (30) are provided; the conveyor (9) comprising a movable push member (13) located in the gap between the two second guides (30).

29. A machine as claimed in claim 15, wherein the packing station (S1) comprises a further feed device for feeding the sheet (4) of packing material crosswise to the path (P), so that the sheet (4) of packing material is intercepted by the product (2) and so folded into a U about the product (2); the packing station (S1) also comprising a packing wheel (14) located downstream from the packing station (S1) and having a pocket (16), which receives the product (2) and the coupon (5) wrapped in the U-folded sheet (4) of packing material, and feeds the product (2) and the coupon (5) through a number of folding stations to fold the two free portions of the sheet (4) of packing material one on top of the other to form a tubular wrapping having two open ends, and to fold the two open ends onto the product (2) to form a closed wrapping.

30. A machine as claimed in claim 29, wherein sealing means are provided to stabilize the closed wrapping by heat sealing superimposed portions of the folded sheet (4) of packing material.

31. A machine as claimed in claim 15, wherein the feed station (S2) comprises a feed wheel (22), which moves a suction gripping head (28) between a pickup station, where it receives the coupon (5), to a release station, where it applies the coupon (5) to the product (2).

* * * * *

UNITED STATES PATENT AND TRADEMARK OFFICE

CERTIFICATE OF CORRECTION

PATENT NO. : 7,124,554 B2
APPLICATION NO. : 11/016817
DATED : October 24, 2006
INVENTOR(S) : Andrea Biondi et al.

It is certified that error appears in the above-identified patent and that said Letters Patent is hereby corrected as shown below:

On the title page, item [73]
Assignee Name:

The Assignee name reads "G.D. Società Per Azioni" should read -- G.D Società Per Azioni--.

Signed and Sealed this

Twenty-sixth Day of June, 2007

JON W. DUDAS
*Director of the United States Patent and Trademark Office*